US010242600B1

(12) United States Patent
Valenti, Jr. et al.

(10) Patent No.: US 10,242,600 B1
(45) Date of Patent: Mar. 26, 2019

(54) WRISTBANDS ON A ROLL

(71) Applicant: Chicago Tag & Label, Inc., Libertyville, IL (US)

(72) Inventors: F. Paul Valenti, Jr., Barrington, IL (US); Carl Opel, Carol Stream, IL (US); Daniel P. Hedger, Grayslake, IL (US)

(73) Assignee: Chicago Tag & Label Inc., Libertyville, IL (US)

( * ) Notice: Subject to any disclaimer, the term of this patent is extended or adjusted under 35 U.S.C. 154(b) by 0 days.

(21) Appl. No.: 15/437,912

(22) Filed: Feb. 21, 2017

Related U.S. Application Data

(60) Provisional application No. 62/298,601, filed on Feb. 23, 2016.

(51) Int. Cl.
*G09F 3/00* (2006.01)
*B41J 3/407* (2006.01)
*G09F 3/10* (2006.01)

(52) U.S. Cl.
CPC ..... *G09F 3/005* (2013.01); *B41J 3/4075* (2013.01); *G09F 3/10* (2013.01)

(58) Field of Classification Search
CPC ..... G09F 3/005; B42D 15/00; B42P 2241/22; A44C 5/0015; A61B 19/44; B41J 3/4075
See application file for complete search history.

(56) References Cited

U.S. PATENT DOCUMENTS 5,279,057 A * 1/1994 Melin ..... G09F 3/00 40/630
8,595,963 B2 * 12/2013 Olivarez ..... G09F 3/0295 40/316

FOREIGN PATENT DOCUMENTS

DE 102012009204 A1 * 11/2013 ..... B32B 5/022

* cited by examiner

*Primary Examiner* — Cassandra Davis
(74) *Attorney, Agent, or Firm* — Ice Miller LLP

(57) ABSTRACT

A continuous series of printable wristbands formed out of an elongate flexible material. A plurality of liner pieces are longitudinally spaced on the undersurface of the elongate flexible material and a plurality of discontinuities are longitudinally spaced on the elongate flexible material to correspond with the plurality of liner pieces. The plurality of discontinuities define a plurality of wristband pieces. The plurality of wristband pieces are detachable from each other at the discontinuities.

19 Claims, 14 Drawing Sheets

110
116
138
142
11
120
114
136
125
118

WRISTBANDS ON A ROLL

CROSS-REFERENCE TO RELATED APPLICATIONS

The present application is a non-provisional of, and claims priority to U.S. Provisional Patent Application No. 62/298,601, filed Feb. 23, 2016, and having the title "WRISTBANDS ON A ROLL," the disclosure of which is incorporated by reference in its entirety.

BACKGROUND

Identification wristbands are commonly used in a hospital or other setting to promote the easy identification of patients or other wearers. In the instance of a hospital use, a patient is generally provided with an identification wristband that is secured about the wrist of the patient upon admission to the hospital.

It is desired to provide an improved form of an identification wristband for use in a hospital and other settings.

SUMMARY

The present disclosure includes disclosure of a continuous series of printable wristbands. In at least one embodiment, a continuous series of printable wristbands according to the present disclosure comprises an elongate flexible material having a longitudinal axis, a top surface, and an opposing undersurface, the elongate flexible material comprising a plurality of liner pieces longitudinally spaced on the undersurface of the elongate flexible material and a plurality of discontinuities longitudinally spaced on the elongate flexible material to correspond with the plurality of liner pieces, the plurality of discontinuities defining a plurality of wristband pieces, the plurality of wristband pieces being detachable from each other at the discontinuities.

The wristband piece according to at least one embodiment of the present disclosure comprises an elongate strip of the flexible material suitable for wrapping around a human limb, the elongate strip comprising an upper surface and an opposing lower surface, the elongate strip being bounded by a first side edge, a second side edge, a leading edge, and a trailing edge, and a first liner segment, the first liner segment comprising a top surface and an opposing bottom surface, the first liner segment removably adhered to the lower surface adjacent the leading edge, the first liner segment covering a minority of the lower surface.

In an aspect of a continuous series of printable wristbands according to the present disclosure, the wristband piece further comprises adhesive between the lower surface of the elongate strip and the first liner segment, wherein when the first liner segment is removed from the elongate strip, at least a portion of the adhesive remains on the lower surface of the elongate strip.

In an aspect of a continuous series of printable wristbands according to the present disclosure, the wristband piece further comprises a timing artifact. In an aspect of a continuous series of printable wristbands according to the present disclosure, the wristband piece further comprises a timing artifact printed on the bottom surface of the first liner segment. In an aspect of a continuous series of printable wristbands according to the present disclosure, the wristband piece further comprises a timing artifact printed on the lower surface of the elongate strip in a region of the lower surface of the elongate strip not covered by the first liner segment.

In an aspect of a continuous series of printable wristbands according to the present disclosure, the wristband piece further comprises a second liner segment, the second liner segment comprising a top surface and an opposing bottom surface, the second liner segment removably adhered to the lower surface adjacent the trailing edge, the second liner segment covering a minority of the lower surface.

The wristband piece according to at least one embodiment of the present disclosure comprises an elongate strip of the flexible material suitable for wrapping around a human limb, the elongate strip comprising an upper surface and an opposing lower surface, the elongate strip being bounded by a first side edge, a second side edge, a leading edge, and a trailing edge, the elongate strip comprising a line of weakness extending between the first side edge and the second side edge, the line of weakness dividing the elongate strip into a wristband and a stub, and a first liner segment, the first liner segment comprising a top surface and an opposing bottom surface, the first liner segment removably adhered to the lower surface adjacent the leading edge and covering the line of weakness, the first liner segment covering a minority of the lower surface.

In an aspect of a continuous series of printable wristbands according to the present disclosure, the wristband piece further comprises adhesive between the lower surface of the elongate strip and the first liner segment, wherein when the first liner segment is removed from the elongate strip, the stub remains adhered to the first liner segment.

The wristband piece according to at least one embodiment of the present disclosure comprises an elongate strip of the flexible material suitable for wrapping around a human limb, the elongate strip comprising an upper surface and an opposing lower surface, the elongate strip being bounded by a first side edge, a second side edge, a leading edge, and a trailing edge, the elongate strip comprising a first line of weakness extending between the first side edge and the second side edge, the elongate strip comprising a second line of weakness extending between the first side edge and the second side edge, the first line of weakness and the second line of weakness dividing the elongate strip into a wristband, a leading stub, and a trailing stub, a first liner segment, the first liner segment comprising a portion of a first liner piece of the plurality of liner pieces, the first liner segment defined by a first discontinuity of the plurality of discontinuities, the first liner segment comprising a top surface and an opposing bottom surface, the first liner segment removably adhered to the lower surface adjacent the leading edge and covering the first line of weakness, the first liner segment covering a minority of the lower surface, and a second liner segment, the second liner segment comprising a portion of a second liner piece of the plurality of liner pieces, the second liner segment defined by a second discontinuity of the plurality of discontinuities, the second liner segment comprising a top surface and an opposing bottom surface, the second liner segment removably adhered to the lower surface adjacent the trailing edge and covering the second line of weakness, the second liner segment covering a minority of the lower surface.

In an aspect of a continuous series of printable wristbands according to the present disclosure, the wristband piece further comprises adhesive between the lower surface of the elongate strip and the first liner segment, wherein when the first liner segment is removed from the elongate strip, the leading stub remains adhered to the first liner segment.

In an aspect of a continuous series of printable wristbands according to the present disclosure, the wristband piece further comprises adhesive between the lower surface of the elongate strip and the second liner segment, wherein when the second liner segment is removed from the elongate strip, at least a portion of the adhesive remains on the lower surface of the wristband.

In an aspect of a continuous series of printable wristbands according to the present disclosure, the wristband piece further comprises adhesive between the lower surface of the elongate strip and the second liner segment, wherein when the second liner segment is removed from the elongate strip, the trailing stub remains adhered to the second liner segment.

In an aspect of a continuous series of printable wristbands according to the present disclosure, the wristband piece further comprises a timing artifact printed on the bottom surface of the second liner segment. In an aspect of a continuous series of printable wristbands according to the present disclosure, the wristband piece further comprises a timing artifact printed on the lower surface of the elongate strip in a region of the lower surface of the elongate strip not covered by the first liner segment or by the second liner segment.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein.

DESCRIPTION

Figure 1:
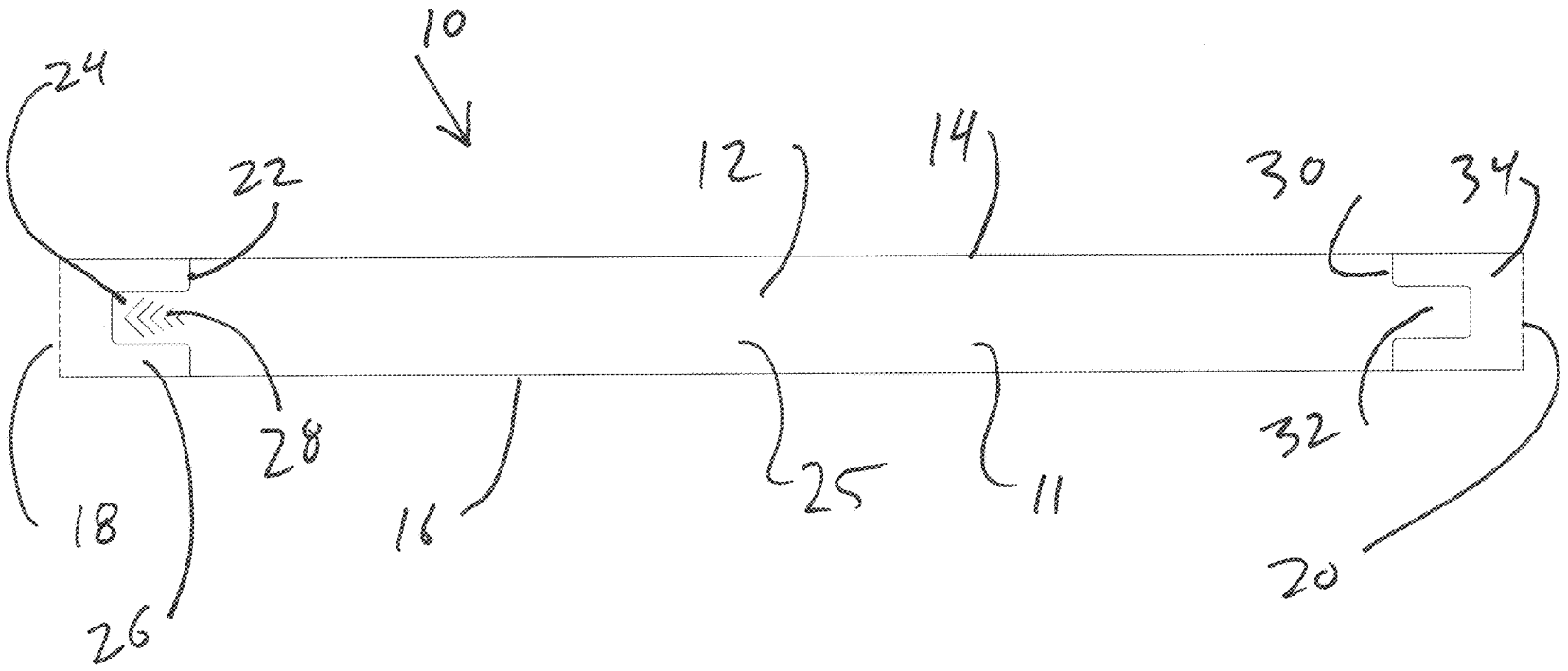
FIG. 1 shows a top view of a wristband piece according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 shows wristband piece 10 according to at least one embodiment of the present disclosure. As shown in FIG. 1, wristband piece 10 comprises an elongate strip of wristband material 11 bounded by first side edge 14, second side edge 16, leading edge 18, and trailing edge 20. In at least one embodiment of the present disclosure, wristband material 11 comprises a polyester material, although other materials suitable for the intended use of wristband piece 10 may be used. Upper surface 12 of wristband piece 10 is visible in FIG. 1. Also shown in FIG. 1 are line of weakness 22 near leading edge 18 and line of weakness 30 near trailing edge 20. Line of weakness 22 extends between first side edge 14 and second side edge 16. Line of weakness 30 also extends between first side edge 14 and second side edge 16.

In the embodiment shown in FIG. 1, wristband piece 10 comprises stub 26 and stub 34. Stub 26 is bounded by first side edge 14, second side edge 16, leading edge 18, and line of weakness 22. Stub 34 is bounded by first side edge 14, second side edge 16, training edge 20, and line of weakness 30. The middle portion of wristband piece 10 comprises wristband 25, which is bounded by first side edge 14, second side edge 16, line of weakness 22, and line of weakness 30. In the embodiment of the present disclosure shown in FIG. 1, line of weakness 22 comprises a contour that defines tab 24 at an end of wristband 25. In the embodiment of wristband piece 10 according to the present disclosure shown in FIG. 1, line of weakness 30 also comprises a contour that defines tab 32 at the end of wristband 25 opposite tab 24. In at least one embodiment of the present disclosure, wristband 25 comprises tamper resistant feature 28 formed in tab 24 of wristband 25, where tamper resistant feature 28 comprises at least one deformation in wristband 25.

Figure 2A:
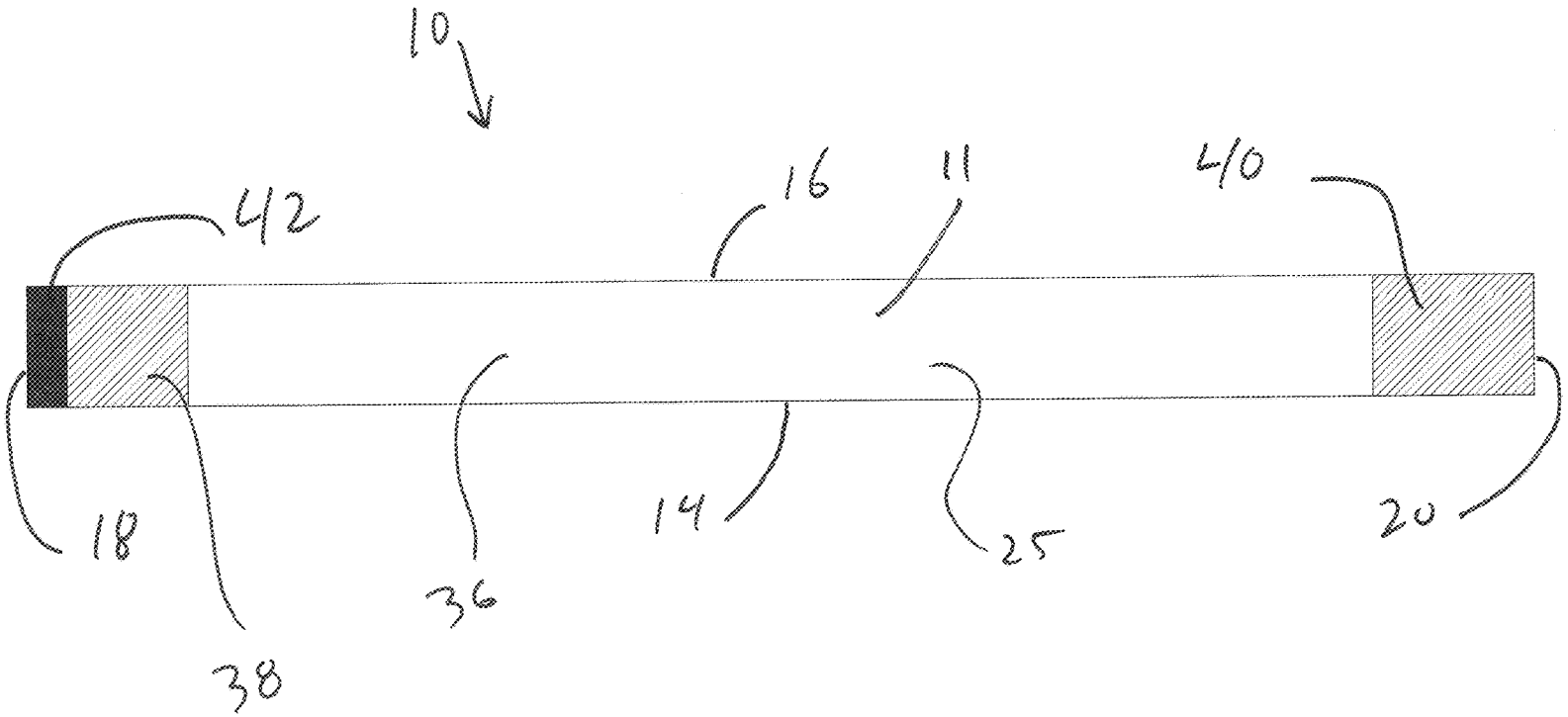
FIG. 2A shows an underside of a wristband piece according to at least one embodiment of the present disclosure.

FIG. 2A shows lower surface 36 of wristband piece 10. Also visible in FIG. 2A are liner segments 38, 40. Liner segments 38, 40 comprise a liner material such as, for example, a paper material at least partially covered with a release coating such as, for example, a silicone material. The lower surfaces of liner segment 38, 40 are visible in FIG. 2A. Liner segments 38, 40 are removably adhered to lower surface 36 of wristband piece 10, with liner segment 38 adjacent to leading edge 18 and liner segment 40 adjacent to trailing edge 20. As such, liner segment 38 underlies tab 24 and stub 26, and liner segment 40 underlies tab 32 and stub 34.

Figure 2B:
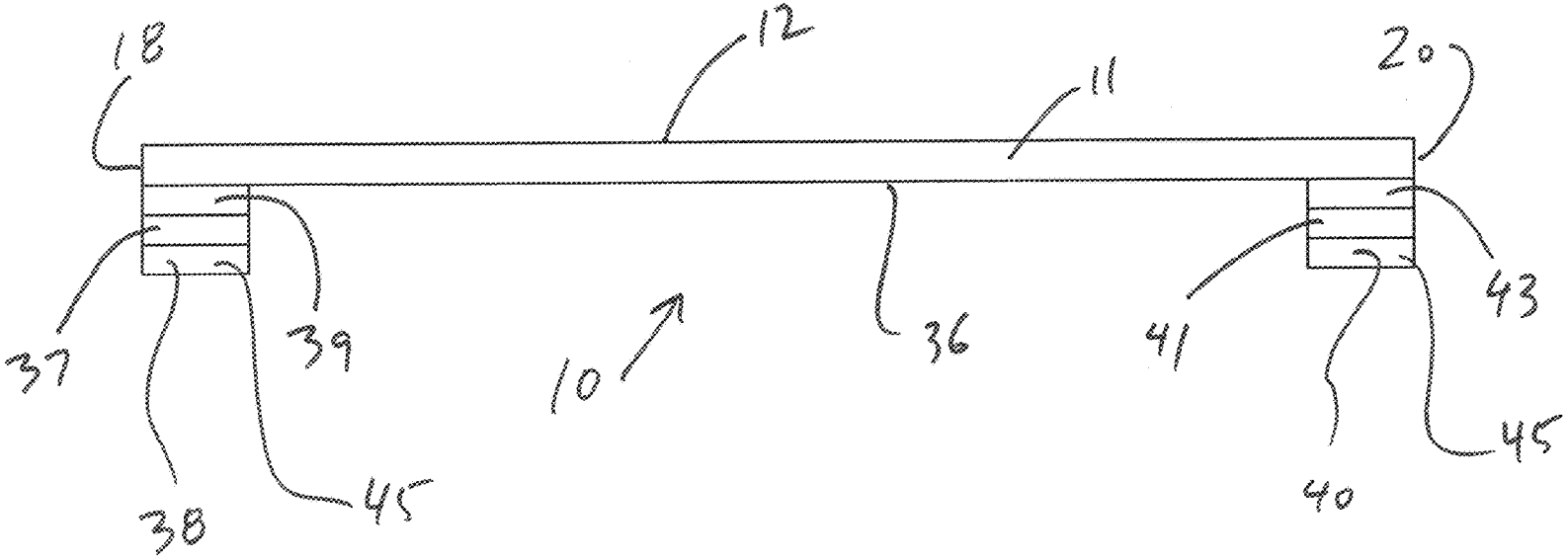
FIG. 2B shows a side view of a wristband piece according to at least one embodiment of the present disclosure.

FIG. 2B shows a side view of wristband piece 10 according to at least one embodiment of the present disclosure, with the proportions enhanced for purposes of clarity. As shown in FIG. 2B, release coating layer 37 covers at least a portion of liner segment 38. Adhesive 39, which in at least one embodiment is a pressure sensitive adhesive, covers at least a portion of release coating layer 37 and is between release coating layer 37 and lower surface 36 of wristband piece 10, thereby removably adhering liner segment 38 to lower surface 36 of wristband piece 10. Also as shown in FIG. 2B, release coating layer 41 covers at least a portion of liner segment 40. Adhesive 43, which in at least one embodiment is a pressure sensitive adhesive, covers at least a portion of release coating layer 41 and is between release coating layer 41 and lower surface 36 of wristband piece 10, thereby removably adhering liner segment 40 to lower surface 36 of wristband piece 10.

Also shown in FIG. 2A is timing artifact 42. In the embodiment of the present disclosure shown in FIG. 2A, timing artifact 42 is printed on liner segment 38 adjacent to leading edge 18. However, timing artifact 42 may be printed anywhere on liner segments 38, 40 or on lower surface 36 and still be within the scope of the present disclosure. Further, timing artifact 42 may be replaced by or supplemented by a punched hole or similar timing artifact and still be within the scope of the present disclosure.

Figure 3:
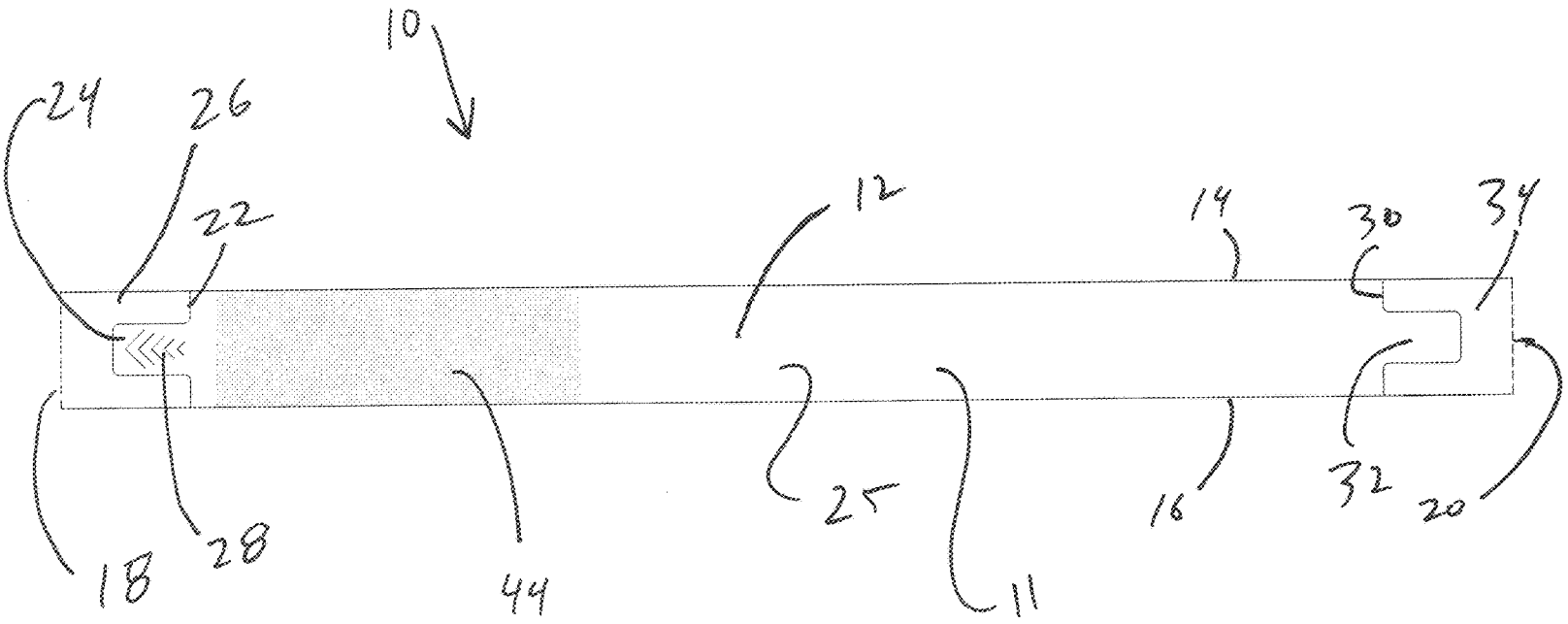
FIG. 3 shows a top view of a wristband piece according to at least one embodiment of the present disclosure.
Figure 4:
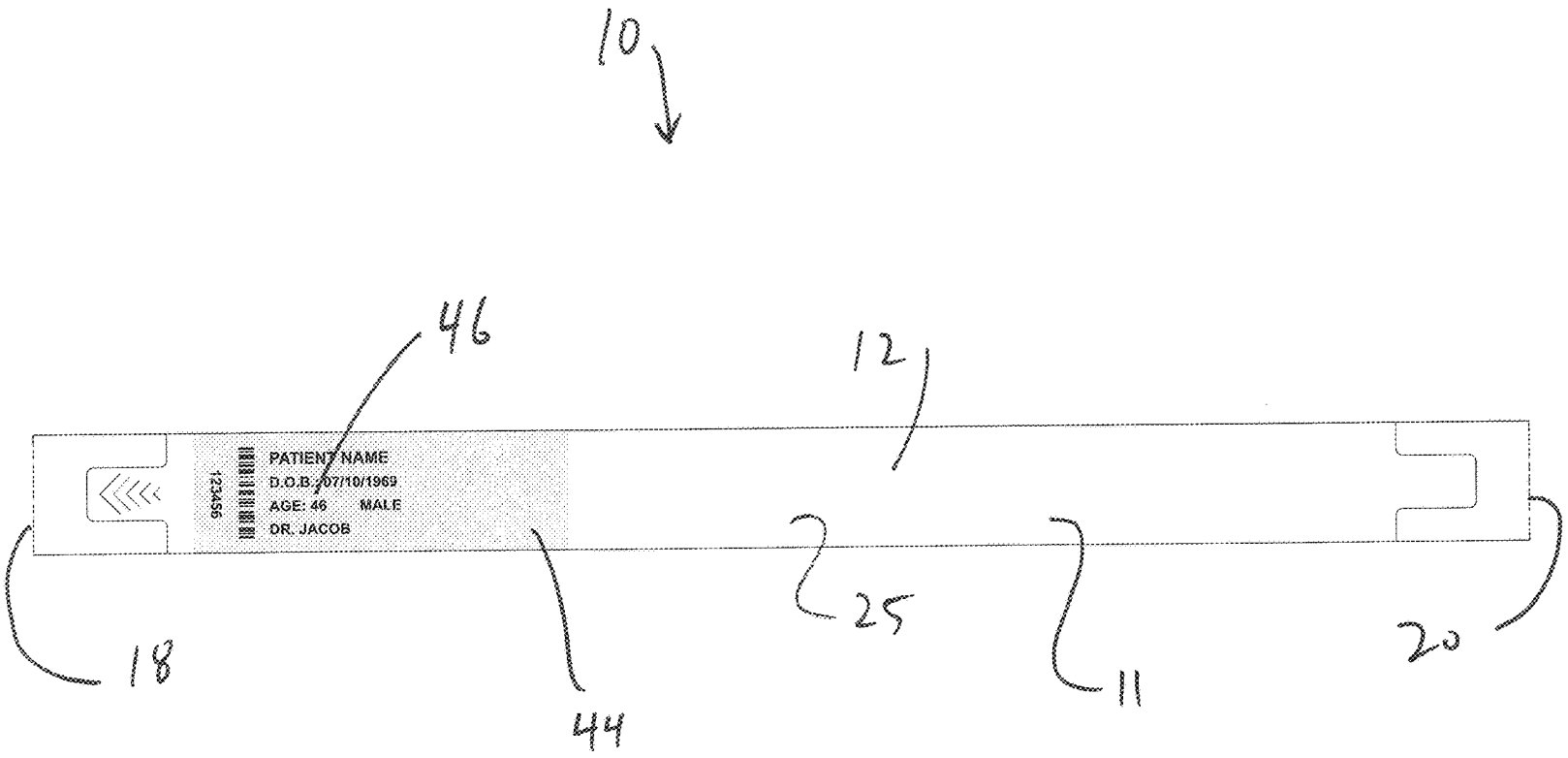
FIG. 4 shows a top view of a wristband piece according to at least one embodiment of the present disclosure.

FIGS. 3-4 show wristband piece 10 according to at least one embodiment of the present disclosure. As shown in FIGS. 3-4, wristband piece 10 comprises scratch resistant coating 44 on at least a portion upper surface 12 of wristband piece 10. FIG. 4 shows indicia 46 in the area of scratch resistant coating 44. In at least one embodiment, indicia 46 is applied to wristband piece 10 by thermal printing. Scratch resistant coating 44 diminishes the likelihood that indicia 46, which could include patient-specific information, will be eroded by the handling of or the wearing of wristband piece 10.

When wristband piece 10 is used, liner segments 38, 40 and stubs 26, 34 are removed from either end of wristband piece 10, leaving behind wristband 25. Removing liner segment 38 exposes adhesive 39 underneath tab 28. Removing liner segment 40 exposes adhesive 43 underneath tab 32. Wristband 25 then may be wrapped around a limb of a patient, with adhesive 39 underneath tab 28 and adhesive 43 underneath tab 32 being adhered to a surface of wristband 25 in the process, thereby securing wristband 25 onto the limb of a patient. No snaps or other separate fasteners are required to attached wristband 25 onto a limb of a patient.

In at least one embodiment of wristband piece 10, lines of weakness 22, 30 are not included. As a result, in such an embodiment there are no tabs 24, 32, or stubs 26, 34. In such an embodiment, liner segments 38, 40 are removed from either end of wristband piece 10, leaving behind wristband 25. In such an embodiment, removing liner segment 38 exposes adhesive 39 on the lower surface 36 of wristband 25 adjacent leading edge 18. In such an embodiment, removing liner segment 40 exposes adhesive 43 on the lower surface 36 of wristband 25 adjacent trailing edge 20. Wristband 25 then may be wrapped around a limb of a patient, with adhesive 39 on the lower surface 36 of wristband 25 adjacent leading edge 18 and adhesive 43 on the lower surface 36 of wristband 25 adjacent trailing edge 20 being adhered to a surface of wristband 25 in the process, thereby securing wristband 25 onto the limb of a patient. No snaps or other separate fasteners are required to attached wristband 25 onto a limb of a patient.

Figure 7A:
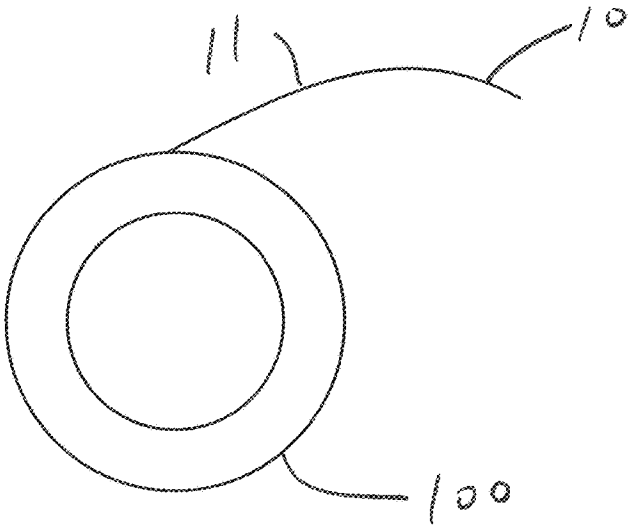
FIG. 7A shows a side view of a roll of wristband pieces according to at least one embodiment of the present disclosure.
Figure 7B:
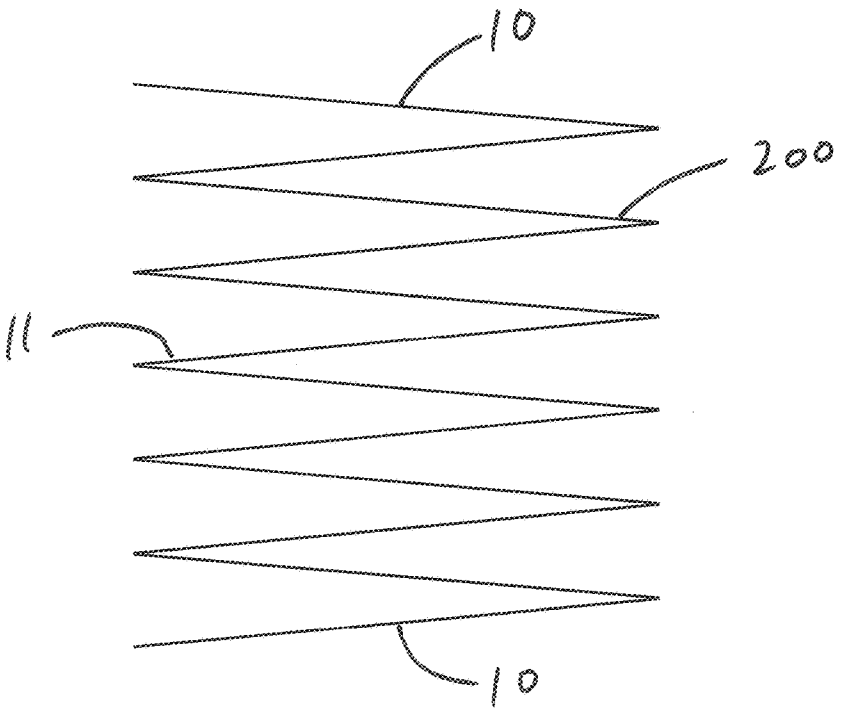
FIG. 7B shows a side view of a stack of wristband pieces according to at least one embodiment of the present disclosure.

In at least one embodiment of the present disclosure, a plurality of wristband pieces 10 are presented in a series, with one or more leading edges 18 of the plurality of wristband pieces 10 connected to one or more trailing edges 20 of adjacent wristband pieces 10. In at least one embodiment of the present disclosure, the plurality of serially connected wristband pieces 10 is arranged into a roll of wristband pieces 10. FIG. 7A shows roll 100, which comprises a plurality of wristband pieces 10 arranged in a series. In at least one embodiment of the present disclosure, the plurality of serially connected wristband pieces 10 is fan folded into a stack of wristband pieces 10. FIG. 7B shows stack 200, which comprises a plurality of fan folded wristband pieces 10 arranged in a series.

Figure 9A:
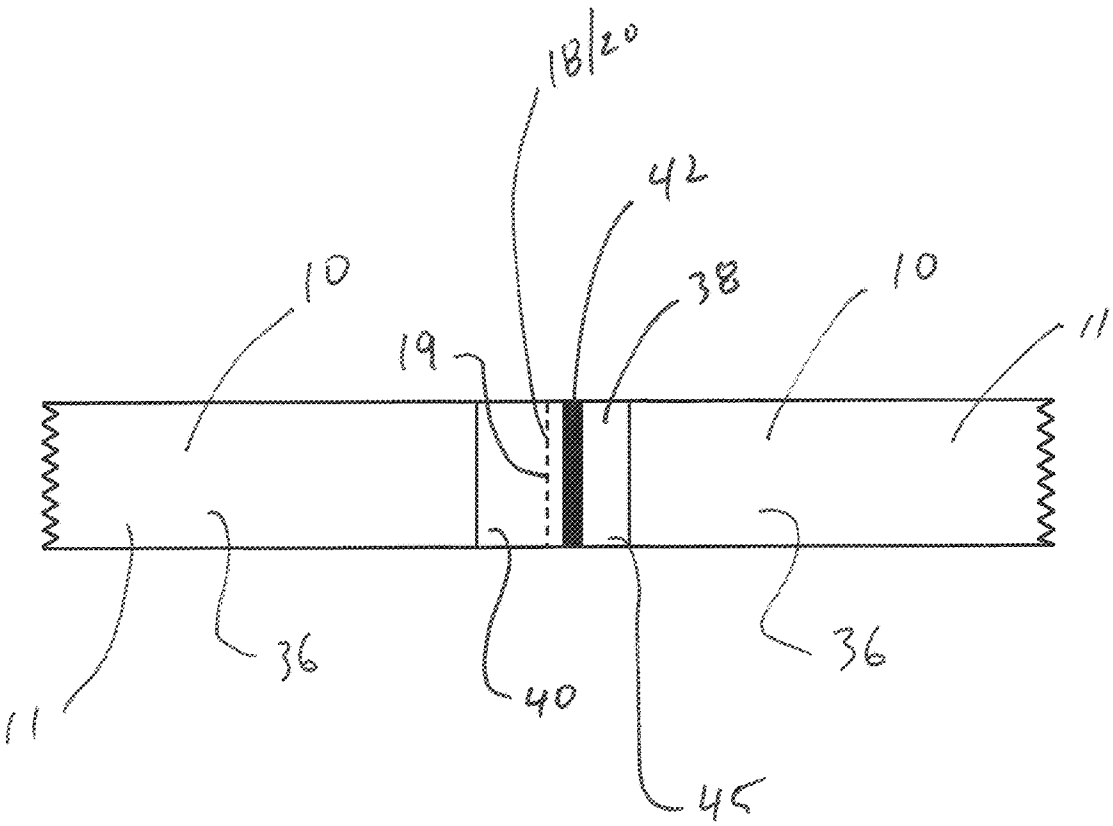
FIG. 9A shows an underside view of a roll of wristband pieces according to at least one embodiment of the present disclosure.
Figure 9B:
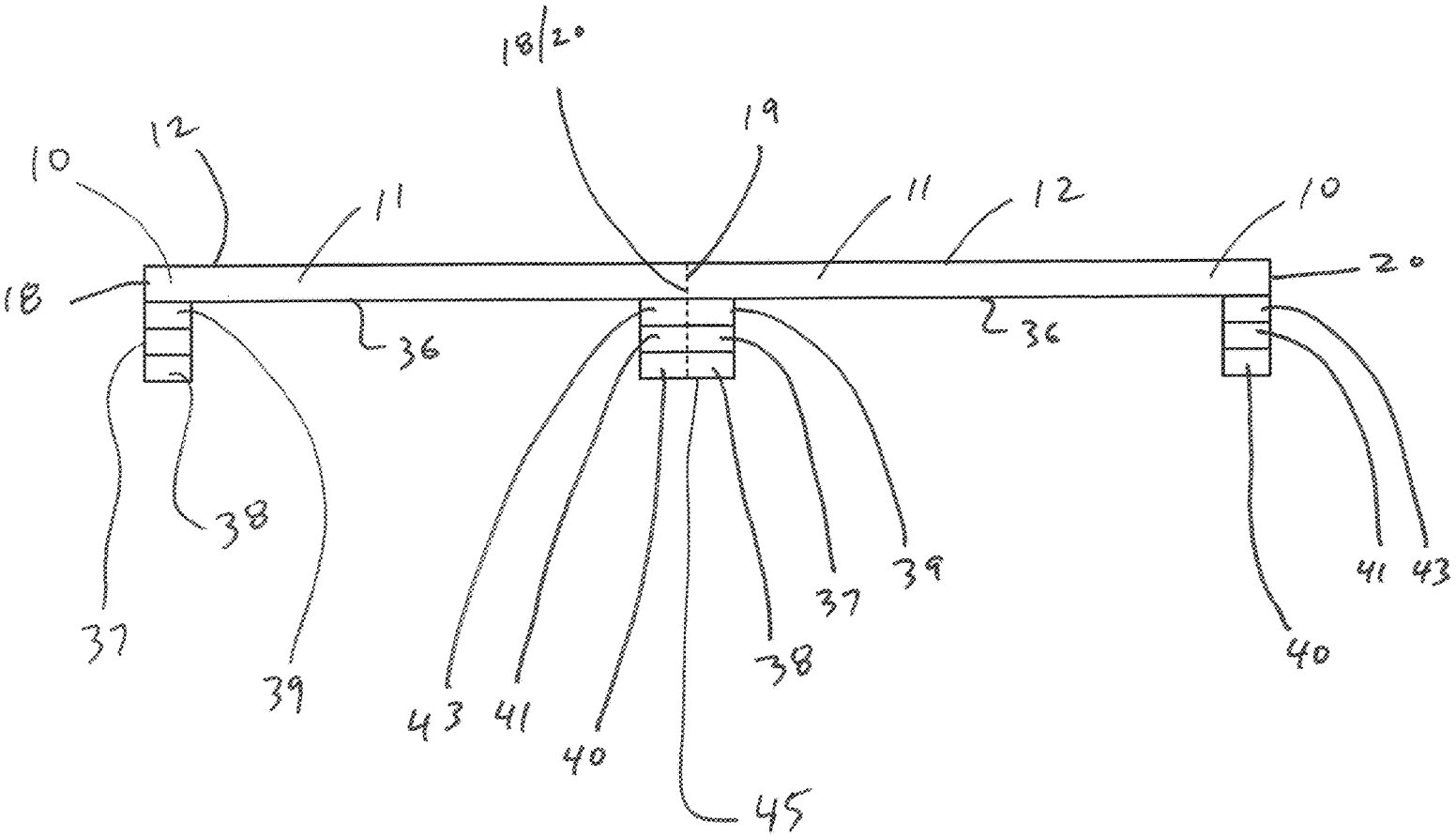
FIG. 9B shows a side view of a portion of a roll of wristband pieces according to at least one embodiment of the present disclosure.

FIG. 9A shows an underside view of a portion of roll 100 according to at least one embodiment of the present disclosure. FIG. 9B shows a side view of a portion of roll 100 according to at least one embodiment of the present disclosure. In the embodiment shown in FIGS. 9A-B, roll 100 comprises an elongate piece of wristband material 11 having a longitudinal axis and a lateral axis. According to at least one embodiment of the present disclosure, a plurality of liner pieces 45 (only one such liner piece 45 is shown in FIGS. 9A-B) are longitudinally spaced on wristband roll 100. According to at least one embodiment of the present disclosure, a plurality of discontinuities 19, such as, for example, a perforation, diecut, or other line of weakness (only one such discontinuity 19 is shown in FIGS. 9A-B) also are longitudinally spaced on wristband roll 100. The longitudinal spacing of each discontinuity 19 coincides with the longitudinal spacing of each liner piece 45. Each discontinuity 19 extends through wristband material 11 and the correspondingly spaced liner piece 45. Each discontinuity 19 thereby defines a leading edge 18 of a first wristband piece 10, and a trailing edge 20 of an adjacent liner piece 10. In a similar way, each discontinuity 19 thereby defines a liner segment 38 of a first wristband piece 10, and a liner segment 40 of an adjacent liner piece 10. In at least one embodiment of the present disclosure, such discontinuities (such as, for example, perforations, diecuts, or other lines of weakness) extend only through wristband material 11 but not through the underlying liner piece 45. It will be appreciated that the arrangement described above can be adapted for a stack 200.

Figure 5:
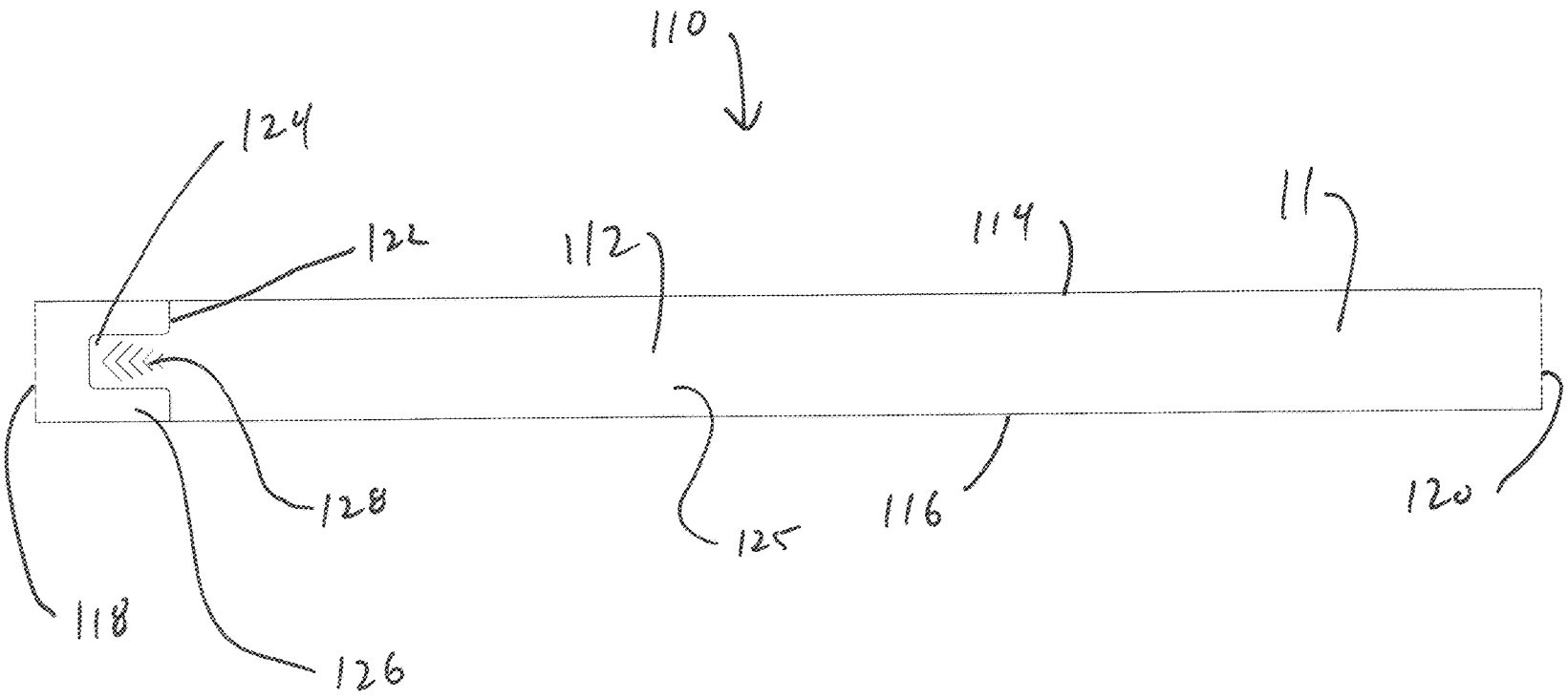
FIG. 5 shows a top view of a wristband piece according to at least one embodiment of the present disclosure.

FIG. 5 shows wristband piece 110 according to at least one embodiment of the present disclosure. As shown in FIG. 5, wristband piece 110 comprises an elongate strip of wristband material 111 bounded by first side edge 114, second side edge 116, leading edge 118, and trailing edge 120. In at least one embodiment of the present disclosure, wristband material 111 is constructed of a polyester material, although other materials suitable for the intended use of wristband piece 110 may be used. Upper surface 112 of wristband piece 110 is visible in FIG. 5. As shown in FIG. 5, line of weakness 122 near leading edge 118 extends between first side edge 114 and second side edge 116.

In the embodiment shown in FIG. 5, wristband piece 110 comprises stub 126, which is bounded by first side edge 114, second side edge 116, leading edge 118, and line of weakness 122. The portion of wristband piece 110 other than stub 126 comprises wristband 125, which is bounded by first side edge 114, second side edge 116, trailing edge 120, and line of weakness 122. In the embodiment of the present disclosure shown in FIG. 5, line of weakness 122 comprises a contour that defines tab 124 at an end of wristband 125. In at least one embodiment of the present disclosure, wristband 125 comprises tamper resistant feature 128 formed in tab 124 of wristband 125, where tamper resistant feature 128 comprises at least one deformation in wristband 125.

Figure 6A:
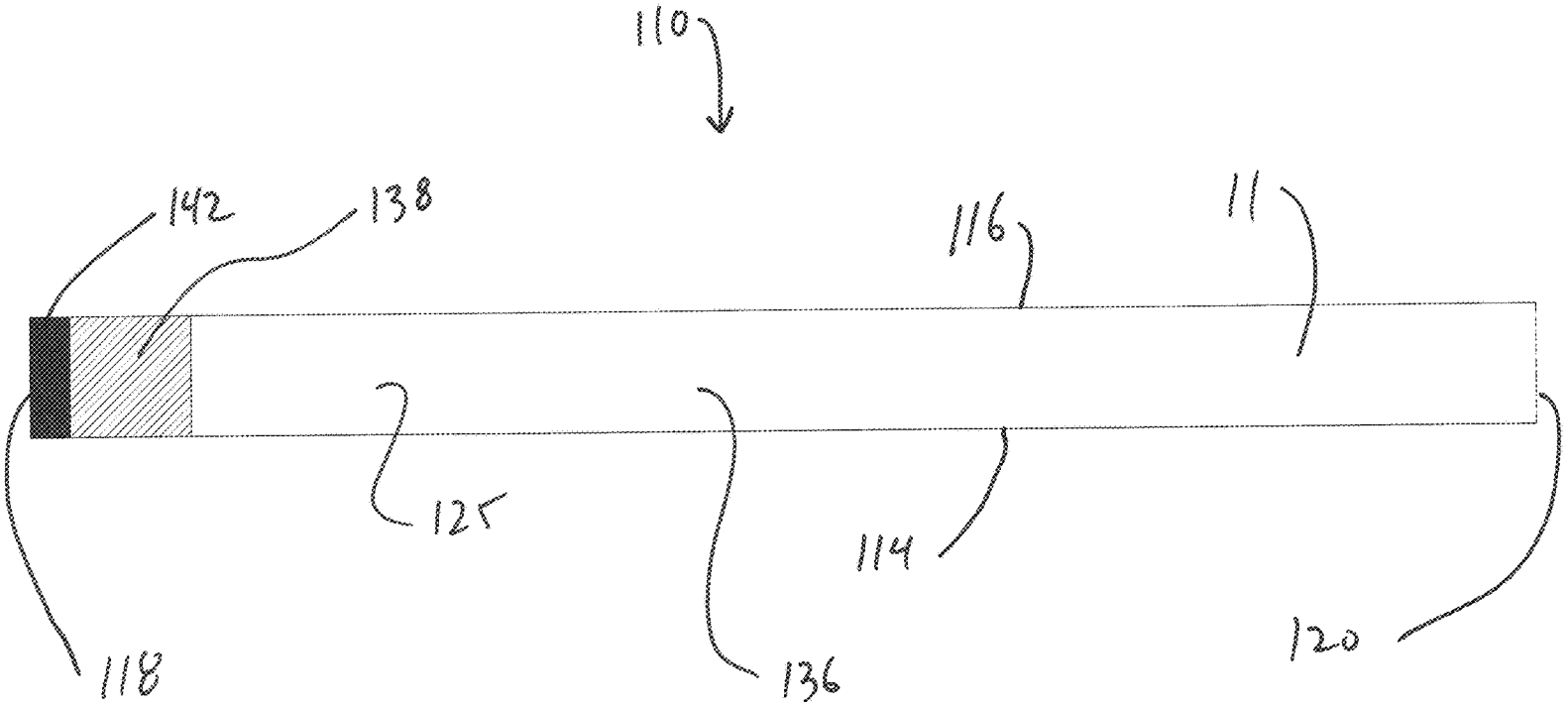
FIG. 6A shows an underside of a wristband piece according to at least one embodiment of the present disclosure.

FIG. 6A shows lower surface 136 of wristband piece 110. Also visible in FIG. 6A is liner segment 138. Liner segment 138 comprises a liner material such as, for example, a paper material at least partially covered with a release coating such as, for example, a silicone material. The lower surface of liner segment 138 is visible in FIG. 6A. Liner segment 138 is removably adhered to lower surface 136 of wristband piece 110, with liner segment 138 adjacent to leading edge 118. As such, liner segment 138 underlies tab 124 and stub 126.

Figure 6B:
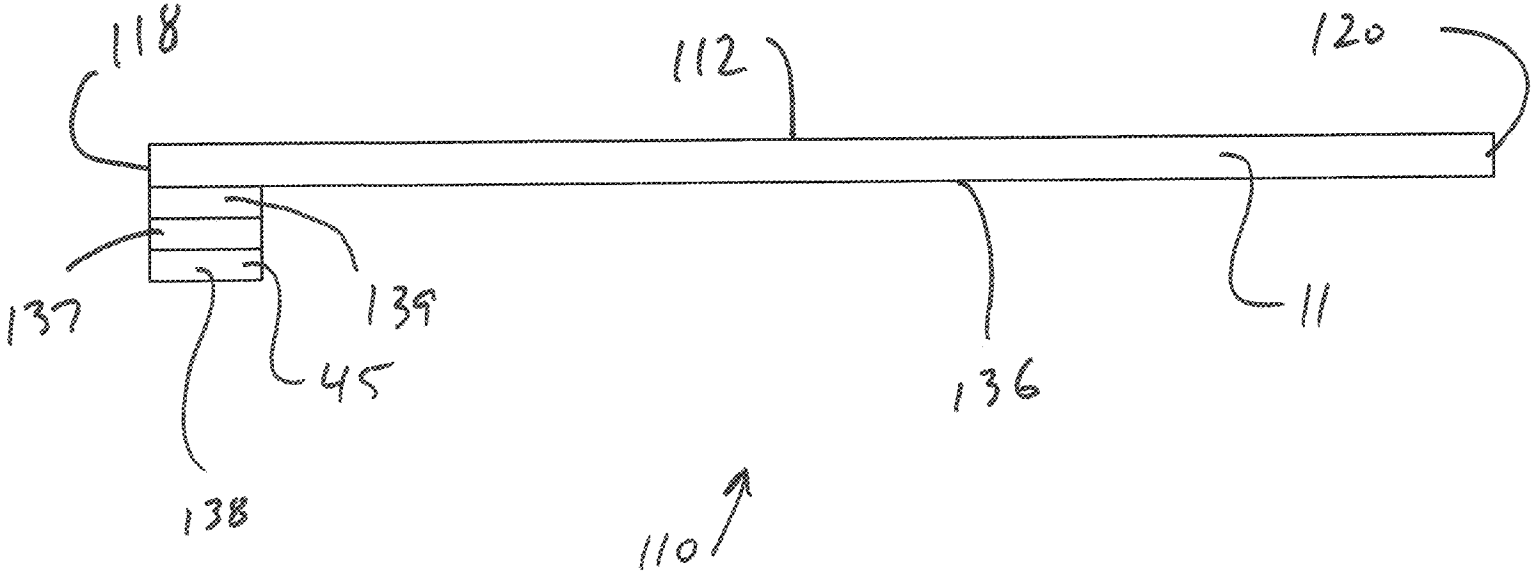
FIG. 6B shows a side view of a wristband piece according to at least one embodiment of the present disclosure.

FIG. 6B shows a side view of wristband piece 110 according to at least one embodiment of the present disclosure, with the proportions enhanced for purposes of clarity. As shown in FIG. 6B, release coating layer 137 covers at least a portion of liner segment 138. Adhesive 139, which in at least one embodiment is a pressure sensitive adhesive, covers at least a portion of release coating layer 137 and is between release coating layer 137 and lower surface 136 of wristband piece 110, thereby removably adhering liner segment 138 to lower surface 136 of wristband piece 110.

Also shown in FIG. 6A is timing artifact 142. In the embodiment of the present disclosure shown in FIG. 6A, timing artifact 142 is printed on liner segment 138 adjacent to leading edge 118. However, timing artifact 142 may be printed anywhere on liner segment 138 or on lower surface 136 and still be within the scope of the present disclosure. Further, timing artifact 142 may be replaced by a punched hole or similar timing artifact and still be within the scope of the present disclosure.

When wristband piece 110 is used, liner segment 138 and stub 126 are removed from the end of wristband piece 110, leaving behind wristband 125. Removing liner segment 138 exposes adhesive 139 underneath tab 128. Wristband 125 then may be wrapped around a limb of a patient, with adhesive 139 underneath tab 128 being adhered to a surface of wristband 125 in the process, thereby securing wristband 125 onto the limb of a patient. No snaps or other separate fasteners are required to attached wristband 125 onto a limb of a patient.

In at least one embodiment of wristband piece 110, line of weakness 122 is not included. As a result, in such an embodiment there is no tab 124 or stub 126. In such an embodiment, liner segment 138 is removed from wristband piece 110, leaving behind wristband 125. In such an embodiment, removing liner segment 138 exposes adhesive 139 on the lower surface 136 of wristband 125 adjacent leading edge 118. Wristband 125 then may be wrapped around a limb of a patient, with adhesive 139 on the lower surface 136 of wristband 125 adjacent leading edge 118 being adhered to a surface of wristband 125 in the process, thereby securing wristband 125 onto the limb of a patient. No snaps or other separate fasteners are required to attached wristband 125 onto a limb of a patient.

Figure 8K:
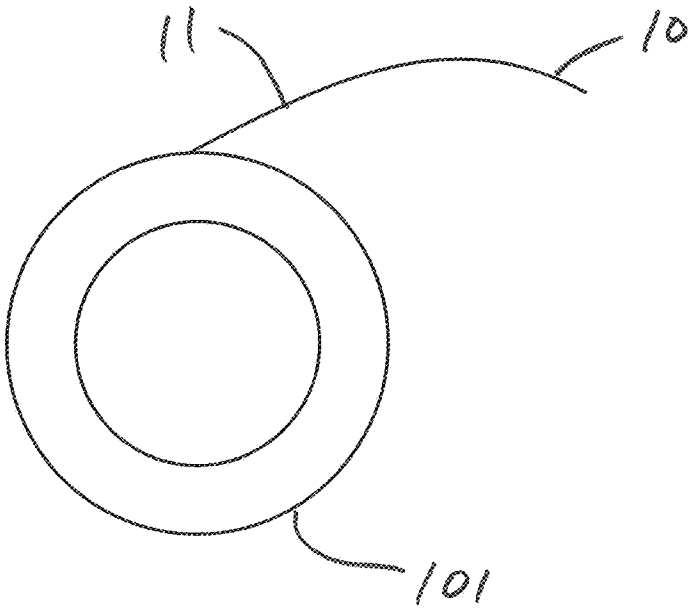
FIG. 8A shows a side view of a roll of wristband pieces according to at least one embodiment of the present disclosure.
FIG. 8B shows a side view of a stack of wristband pieces according to at least one embodiment of the present disclosure.
Figure 8B:
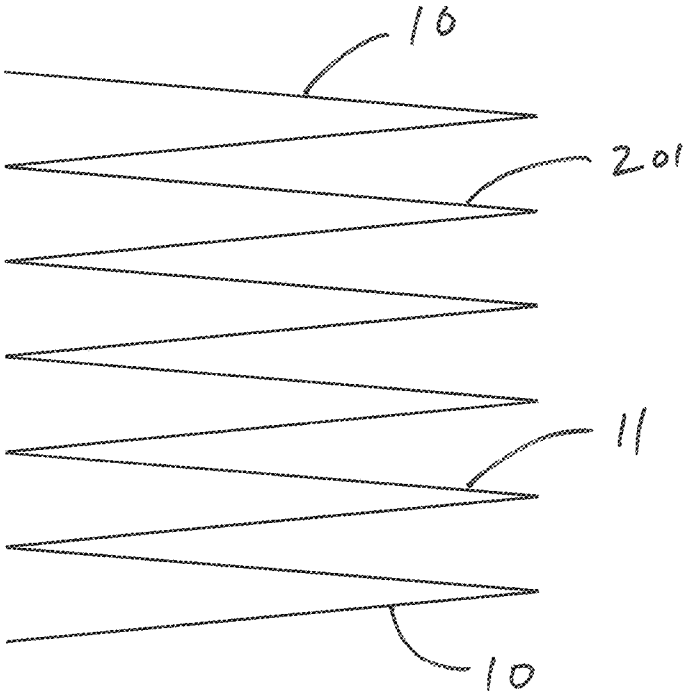

In at least one embodiment of the present disclosure, a plurality of wristband pieces 110 are presented in a series, with one or more leading edges 118 of the plurality of wristband pieces 110 connected to one or more trailing edges 120 of adjacent wristband pieces 110. In at least one embodiment of the present disclosure, the plurality of serially connected wristband pieces 110 is arranged into a roll of wristband pieces 110. FIG. 8A shows roll 101, which comprises a plurality of wristband pieces 110 arranged in a series. In at least one embodiment of the present disclosure, the plurality of serially connected wristband pieces 110 is fan folded into a stack of wristband pieces 110. FIG. 8B shows stack 201, which comprises a plurality of fan folded wristband pieces 110 arranged in a series.

In at least one embodiment where a plurality of wristband pieces 110 are presented in a series, discontinuities, (such as, for example, perforations, diecuts, or other lines of weakness) separate each of the plurality of wristband pieces 110 from the adjacent wristband piece 110. Such discontinuities (such as, for example, perforations, diecuts, or other lines of weakness) form leading edge 118 and trailing edge 120 of each wristband piece 110. In at least one embodiment of the present disclosure, such discontinuities (such as, for example, perforations, diecuts, or other lines of weakness) extend through wristband piece 110 and through the underlying liner segment 138. In at least one embodiment of the present disclosure, such discontinuities (such as, for example, perforations, diecuts, or other lines of weakness) extend only through wristband piece 110 but not through the underlying liner segment 138.

While this disclosure has been described as having preferred designs, the apparatus and methods according to the present disclosure can be further modified within the scope and spirit of this disclosure. This application is therefore intended to cover any variations, uses, or adaptations of the disclosure using its general principles. For example, any methods disclosed herein and in the appended claims represent one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

We claim:

1. A continuous series of printable wristbands comprising:

an elongate flexible material having a longitudinal axis, a top surface, and an opposing undersurface, said elongate flexible material comprising a plurality of liner pieces longitudinally spaced on said undersurface of said elongate flexible material and a plurality of discontinuities longitudinally spaced on said elongate flexible material to correspond with said plurality of liner pieces, said plurality of discontinuities defining a plurality of wristband pieces, said plurality of wristband pieces being detachable from each other at said discontinuities, each said wristband piece comprising:

an elongate strip of said flexible material suitable for wrapping around a human limb, said elongate strip comprising an upper surface and an opposing lower surface, said elongate strip being bounded by a first side edge, a second side edge, a leading edge, and a trailing edge, said elongate strip comprising a line of weakness extending between said first side edge and said second side edge, said line of weakness dividing said elongate strip into a wristband and a stub, a first liner segment, said first liner segment comprising a top surface and an opposing bottom surface, said first liner segment removably adhered to said lower surface adjacent said leading edge and covering said line of weakness, said first liner segment covering a minority of said lower surface, and adhesive between said lower surface of said elongate strip and said first liner segment, wherein when said first liner segment is removed from said elongate strip, said stub remains adhered to said first liner segment.

2. The continuous series of printable wristbands of claim 1, wherein when said first liner segment is removed from said elongate strip, at least a portion of said adhesive remains on said lower surface of said wristband.

3. The continuous series of printable wristbands of claim 1, wherein each said wristband piece further comprises a timing artifact.

4. The continuous series of printable wristbands of claim 1, wherein said wristband piece further comprises a timing artifact printed on said bottom surface of said first liner segment.

5. The continuous series of printable wristbands of claim 1, wherein said wristband piece further comprises a timing artifact printed on said lower surface of said elongate strip in a region of said lower surface of said elongate strip not covered by said first liner segment.

6. The continuous series of printable wristbands of claim 1, wherein each said wristband piece further comprises a second liner segment, said second liner segment comprising a top surface and an opposing bottom surface, said second liner segment removably adhered to said lower surface adjacent said trailing edge, said second liner segment covering a minority of said lower surface.

7. A continuous series of printable wristbands comprising;

an elongate flexible material having a longitudinal axis, a top surface, and an opposing undersurface, said elongate flexible material comprising a plurality of liner pieces longitudinally spaced on said undersurface of said elongate flexible material and a plurality of discontinuities longitudinally spaced on said elongate flexible material to correspond with said plurality of liner pieces, said plurality of discontinuities defining a plurality of wristband pieces, said plurality of wristband pieces being detachable from each other at said discontinuities, each said wristband piece comprising:

an elongate strip of said flexible material suitable for wrapping around a human limb said, elongate strip comprising an upper surface and an opposing lower surface, said elongate strip being bounded by a first side edge, a second side edge, a leading edge, and a trailing edge, said elongate strip comprising a first line of weakness extending between said first side edge and said second side edge, said elongate strip comprising a second line of weakness extending between said first side edge and said second side edge, said first line of weakness and said second line of weakness dividing said elongate strip into a wristband, a leading stub, and a trailing stub, a first liner segment, said first liner segment comprising a portion of a first liner piece of said plurality of liner pieces, said first liner segment defined by a first discontinuity of said plurality of discontinuities said first liner segment comprising a top surface and an opposing bottom surface, said first liner segment removably adhered to said lower surface adjacent said leading edge and covering said first line of weakness, said first liner segment covering a minority of said lower surface, a second liner segment, said second liner segment comprising a portion of a second liner pieee of said plurality of liner pieces, said second liner segment defined by a second discontinuity of said plurality of discontinuities, said second liner segment comprising a top surface and an opposing bottom surface, said second liner segment removably adhered to said lower surface adjacent said trailing edge and covering said second line of weakness, said second liner segment covering a minority of said lower surface, and adhesive between said lower surface of said elongate strip and said first liner segment, wherein when said first liner segment is removed from said elongate strip, said leading stub remains adhered to said first liner segment.

8. The continuous series of printable wristbands of claim 7, wherein when said first liner segment is removed from said elongate strip, at least a portion of said adhesive remains on said lower surface of said wristband.

9. The continuous series of printable wristbands of claim 7, wherein each said wristband piece further comprises adhesive between said lower surface of said elongate strip and said second liner segment, wherein when said second liner segment is removed from said elongate strip, at least a portion of said adhesive remains on said lower surface of said wristband.

10. The continuous series of printable wristbands of claim 7, wherein each said wristband piece further comprises a timing artifact.

11. The continuous series of printable wristbands of claim 7, wherein said wristband piece further comprises a timing artifact printed on said bottom surface of said first liner segment.

12. The continuous series, of printable wristbands of claim 7, wherein said wristband piece further comprises a timing artifact printed on said bottom surface of said second liner segment.

13. The continuous series of printable wristbands of claim 7, wherein said wristband piece further comprises a timing artifact printed on said lower surface of said elongate strip in a region of said lower surface of said elongate strip not covered by said first liner segment or by said second liner segment.

14. A continuous series of printable wristbands comprising:

an elongate flexible material having a longitudinal axis, a top surface, and an opposing undersurface, said elongate flexible material comprising a plurality of liner pieces longitudinally spaced on said undersurface of said elongate flexible material and a plurality of discontinuities longitudinally spaced on said elongate flexible material to correspond with said plurality of liner pieces, said plurality of discontinuities defining a plurality of wristband pieces, said plurality of wristband pieces being detachable from each other at said discontinuities, each said wristband piece comprising:

an elongate strip of said flexible material suitable for wrapping around a human limb, said elongate strip comprising an upper surface and an opposing lower surface, said elongate strip being bounded by a first side edge, a second side edge, a leading edge, and a trailing edge, said elongate strip comprising a first line of weakness extending between said first side edge and said second side edge, said elongate strip comprising a second line of weakness extending between said first side edge and said second side edge, said first line of weakness and said second line of weakness dividing said elongate strip into a wristband, a leading stub, and a trailing stub, a first liner segment, said first liner segment comprising a portion of a first liner piece of said plurality of liner pieces, said first liner segment defined by a first discontinuity of said plurality of discontinuities, said first liner segment comprising a top surface and an opposing bottom surface, said first liner segment removably adhered to said lower surface adjacent said leading edge and covering said first line of weakness, said first liner segment covering a minority of said lower surface, a second liner segment, said second liner segment comprising a portion of a second liner piece of said plurality of liner pieces, said second liner segment defined by a second discontinuity of said plurality of discontinuities, said second liner segment comprising a top surface and an opposing bottom surface, said second liner segment removably adhered to said lower surface aliment said trailing edge and covering said second line of weakness, said second liner segment covering a minority of said lower surface, and adhesive between said lower surface of said elongate strip and said second liner segment, wherein when said second liner segment is removed from said elongate strip, said trailing stub remains adhered to said second liner segment.

15. The continuous series of printable wristbands of claim 14, wherein when said second liner segment is removed from said elongate strip, at least a portion of said adhesive remains on said lower surface of said wristband.

16. The continuous series of printable wristbands of claim 14, wherein each said wristband piece further comprises a timing artifact.

17. The continuous series of printable wristbands of claim 14, wherein said wristband piece further comprises a timing artifact printed on said bottom surface of said first liner segment.

18. The continuous series of printable wristbands of claim 14, wherein said wristband piece further comprises a timing artifact printed on said bottom surface of said second liner segment.

19. The continuous series of printable wristbands of claim 14, wherein said wristband piece further comprises a timing artifact printed on said lower surface of said elongate strip in a region of said lower surface of said elongate strip not covered by said first liner segment or by said second liner segment.

* * * * *